United States Patent [19]

McCoy et al.

[11] Patent Number: 4,777,799

[45] Date of Patent: Oct. 18, 1988

[54] MEMORY ELEMENT

[75] Inventors: William C. McCoy, Zionsville, Ind.; Frederick E. Wang, Silver Spring, Md.; James E. Small; Gregory A. Cole, both of Indianapolis, Ind.

[73] Assignee: Catheter Research, Inc., Zionville, Ind.

[21] Appl. No.: 104,641

[22] Filed: Oct. 2, 1987

[51] Int. Cl.[4] ..... F03G 7/06

[52] U.S. Cl. ..... 60/528; 60/527

[58] Field of Search ..... 60/527, 528, 529

[56] References Cited

U.S. PATENT DOCUMENTS

| | | | |
|---|---|---|---|
| 3,290,479 | 12/1966 | Avedissian | 219/85 |
| 3,520,055 | 7/1970 | Jannett | 29/628 |
| 3,890,977 | 6/1975 | Wilson | 128/418 |
| 4,135,224 | 1/1979 | Maher | 361/321 |
| 4,229,865 | 10/1980 | Fanning | 29/25.42 |
| 4,238,661 | 12/1980 | Braunlich | 219/121 |
| 4,327,277 | 4/1982 | Daly | 219/121 |
| 4,411,655 | 10/1983 | Schreck | 604/165 |
| 4,543,090 | 9/1985 | McCoy | 604/95 |
| 4,551,974 | 11/1985 | Yaeger et al. | 60/528 X |
| 4,601,705 | 7/1986 | McCoy | 604/95 |
| 4,605,835 | 8/1986 | Deffeyes | 219/85 |

FOREIGN PATENT DOCUMENTS 60-145385 7/1985 Japan .

OTHER PUBLICATIONS

*J. Ap. Phys.*, vol. 36, No. 10, pp. 3232–3239, Oct. 1965, F. E. Wang et al.

*J. Ap. Phys*, vol. 39, No. 5, pp. 2166–2175, Apr. 1968, F. E. Wang et al.

*Primary Examiner*—Allen M. Ostrager

*Attorney, Agent, or Firm*—Barnes & Thornburg

[57] ABSTRACT

A memory element made of a shape-memory alloy includes lead-attachment and shape-memory portions and a partition interconnecting such portions. The lead-attachment and shape-memory portions are comprised of characteristic internal structures, while the partition is comprised of an internal structure dissimilar to the characteristic internal structure of at least one of the lead-attachment and shape-memory portions. Shape-memory effect characteristics of the shape-memory portion are preserved to maintain the memory function of the memory element by configuring the dissimilar internal structure to block transmigration from the lead-attachment to the shape-memory portions of selected contaminant material existing in the lead-attachment portion. The partition functions as a contaminant filter to control the concentration of contaminant material in the shape-memory portion, thereby enhancing the durability of the memory element. A method is disclosed of altering the first crystalline structure of an uncontaminated memory element to provide the dissimilar, contaminant migration-blocking, internal structure.

48 Claims, 2 Drawing Sheets

MEMORY ELEMENT

BACKGROUND AND SUMMARY OF THE INVENTION

The present invention relates to temperature-activated memory elements made of a shape memory alloy. More particularly, the present invention relates to a bifurcated memory element having at least a lead-attachment portion and a substantially uncontaminated shape-memory portion and a method of making such a bifurcated memory element.

Alloys exhibiting a shape-memory effect are well known. For example, alloys of nickel-titanium, gold-cadmium, iron-platinum, indium-cadmium, iron-nickel, nickel-aluminum, and others have been observed to exhibit shape-memory characteristics. These alloys are known to exhibit a shape-memory effect upon martensitic transformation from a parent phase to a martensitic, or reversely, from a martensitic to a parent phase. Many properties of such alloys are discussed, for example, in *Shape Memory Effects in Alloys,* edited by Jeff Perkins, 583 pages, Plenum Press (1975).

During development of the present invention, temperature-activated memory elements made of shape-memory alloys were observed to experience varying degrees of dysfunction after several temperature-activation cycles. Such dysfunction is characterized, in part, by an inability of the memory element to move to assume its predetermined shape during reverse martensitic transformation when heated to a predetermined temperature. It was experimentally determined that such dysfunction results from introduction of contaminants into the memory element. These contaminanta may come from, for example, an electrically conductive lead or the like which is cohered to the memory element to permit an electric flow so as to heat the memory element to its predetermined temperature.

Contamination of a memory element is thought to result from introduction of certain ions into the crystal lattice of the shape-memory alloy comprising the memory element during martensitic transformation. An electrically conductive lead, solder, or the like cohered (i.e., soldered or welded) to the memory element provides a source of said certain foreign ions. For example, ions of silver, cadmium, lead, iron, or other ions are thought to enter and "poison" the crystalline structure of the shape-memory alloyed mechanism, thereby damaging or otherwise weakening the shape-memory effect function of the memory element during martensitic transformation.

During martensitic transformation, nickel-titanium shape-memory alloys (nitinol) undergo a "second order transformation" having an undefined intermediate phase between the parent phase and martensite. The crystal lattice of such alloys provides an internal structure which is very susceptible to migration and diffusion of foreign ions. Reference is hereby made to F. E. Wang, W. J. Buehler, and S. J. Pickart, "Crystal Structure and a Unique 'Martensitic' Transition of TiNi," *J.Ap.Phys.*, 36 (1965); and F. E. Wang, B. F. DeSavage, and W. J. Buehler, "The Irreversible Critical Range in the TiNi Transition," *J.Ap.Phys.*, 39 (1968) for descriptions of transformation characteristics and properties of nitinol.

Ionic contamination of such shape-memory alloyed mechanisms is thought to result in part, from a complete or partial migration of contaminant ions through the mechanism during martensitic transformation. Essentially, the contaminant ions enter the mechanism at a lead-attachment site and then migrate individually or by means of a "domino-type" effect through the entire mechanism. It has been observed in the development of the present invention that relatively small concentrations of such ionic contaminants in a mechanism are sufficient to damage or weaken the shape-memory effect function of the mechanism.

One object of the present invention is to provide a memory element configured to move to assume its predetermined shape repeatedly when heated to its predetermined transition temperature without experiencing significant functional degradation due to contamination.

Another object of the present invention is to provide a memory element cohered (soldered or welded) to a lead wire or the like which can still move to assume its predetermined shape repeatedly without experiencing significant functional degradation due to contamination when subjected to thermal cycling through the transformation.

Yet another object of the present invention is to minimize dysfunction of a memory element by controlling the introduction of contaminants into the crystal lattice of a selected shape-memory portion of the memory element so that contaminant concentration levels in the selected shape-memory portion are regulated.

Still another object of the present invention is to provide a method of acting upon a memory element to disrupt the crystalline structure of a selected portion thereof or otherwise alter the selected portion to form barrier means in the memory element for limiting the migration of selected ionic materials or other contaminants across the memory element.

According to the present invention, a memory element made of a shape-memory alloy is provided. The memory element includes first and second portions, each portion having a characteristic internal structure, and partition means for interconnecting the first and second portions. The partition means has an internal structure dissimilar to the internal structures of at least one of the first and second portions.

In preferred embodiments, the memory element further includes an electrically conductive lead and connection means for coupling the electrically conductive lead to the first portion. Through the lead, electrical energy is communicated to the memory element. This energy acts to heat the memory element to a predetermined transformation temperature.

Preferably, the first portion functions as a lead-attachment portion and the second portion functions as a shape-memory portion. The dissimilar internal structure is configured to block transmigration between the first and second portions of selected ions originally communicated to the first portion. The dissimilar crystal structure provides a barrier that is in a state that does not undergo martensitic transformation and thus is not conducive to ion migration but serves to provide a block preventing ions from migrating into the second portion. Preservation of the shape-memory effect in the second portion is one advantageous result of such an ion migration-blocking configuration in the partition means.

At the same time, the dissimilar internal structure is configured to provide means for communicating electrically energy from the first "lead-attachment" portion to the second "shape-memory" portion. Such energy acts to heat the second "shape-memory" portion to a predetermined temperature so that at least the second portion moves to assume its predetermined shape.

In use, the dissimilar internal structure forming the partition means is thought to filter certain ions moving from the first portion toward the second portion so that such ions are substantially isolated or otherwise contained in the first portion. Advantageously, such containment effectively limits to the first portion any degradation of the shape-memory effect function of the memory element that might occur due to ionic contamination. Thus, the substantially uncontaminated second portion is free to assume its "memorized" shape when heated to its memory temperature, even though the first portion may not function in quite the same way.

Also in accordance with the present invention, a method is provided of making a temperature-activated memory element. The method includes the steps of providing a mechanism made of a shape-memory alloy having a crystalline structure and exposing a selected portion of the mechanism to an energy source to divide the mechanism into first and second portions interconnected by the selected portion. The energy exposing step is continued for at least a predetermined period of time to disrupt and alter the crystalline structure of the selected portion to provide a dissimilar structure configured to block transmigration of selected ions between the first and second portions.

In preferred embodiments, the energy source is a laser. The method can further include the step of connecting an electrically conductive lead only to the first portion after the exposing and continuing steps to provide means for applying an electric current to the mechanism. The selected portion advantageously provides a partition or thermally-stressed zone intermediate the first and second portions to isolate substantially in the first portion selected ions communicated from the electrically conductive lead to the first portion. Such isolation aids in minimizing ionic contamination of the second portion, thereby substantially preserving the shape-memory effect of the alloy mechanism comprising the second portion.

Additional objects, features, and advantages of the invention will become apparent to those skilled in the art upon consideration of the following detailed description of preferred embodiments exemplifying the best modes of carrying out the invention as presently perceived.

BRIEF DESCRIPTION OF THE DRAWINGS

The detailed description particularly refers to the accompanying figures in which.

DETAILED DESCRIPTION OF THE DRAWINGS

Maintaining a shape-memory effect characteristic of a shape-memory alloy mechanism after such alloy mechanism has been transformed into a memory element with attached wire leads is of central importance to the apparatus and method of the present invention. Treatment of a section of the alloy mechanism using an energy source such as a laser disrupts or alters the crystalline structure of that section of the mechanism sufficiently to block significant transmigration of predetermined ionic material across the section. The "disrupted" section is a thermally-stressed zone which acts as a barrier to ion flow or movement in the mechanism from a lead-attachment portion to a shape-memory portion. The "ion flow" barrier aids in preventing significant ion contamination of the shape-memory portion by ions existing in the lead-attachment portion, which ions operate to weaken the shape-memory effect of the alloy itself. Advantageously, such an ion flow barrier preserves the shape-memory effect characteristics of the mechanism's shape-memory portion to enhance the durability and useful life of the memory mechanism.

Figure 1:
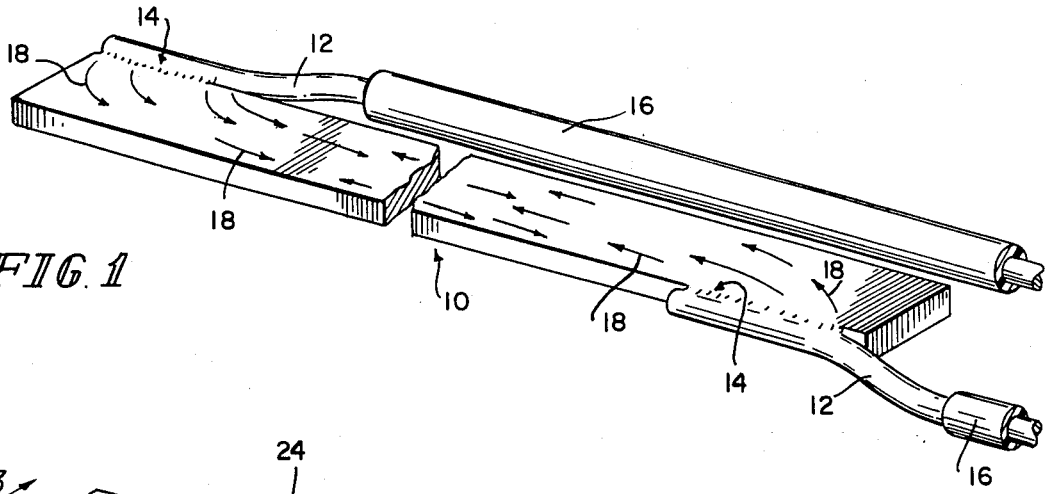
FIG. 1 is a perspective view of a contaminated memory element.

A contaminated memory element 10 is illustrated in FIG. 1. Each wire lead 12 is connected to memory element 10 at junction 14 by conventional connection means (e.g., welding, soldering, etc.) to conduct electricity to the memory element for element-heating purposes. Typically, wire lead 12 is made of silver and partially covered with insulation 16. In the illustrated embodiment, a heat source was used to melt the silver wire lead, thereby fusing the wire lead to the memory element. In another embodiment (not shown), solder can be used to melt and fuse the wire lead to the memory element.

Arrows 18 represent the flow of ions communicated to memory element 10 from wire lead 12 and/or connection means (in the case of solder or the like). The presence of ionic material 18 in the alloy mechanism comprising memory element 10 creates an impurity which has a concentration significant enough to weaken shape-memory effect characteristics of the alloy mechanism. Ionic contamination of nickel-titanium alloys (nitinol) of the type generally used in the manufacture of temperature-activated memory elements has been observed during development of the present invention to limit the functional life of such memory elements.

On a molecular level, it is thought that ionic material rapidly migrates through and defiles the crystal lattice of the alloy mechanism sufficiently to damage certain shape-memory effect characteristics of the alloy mechanism. Although the nature of such ion movement is not fully understood, it is thought that the ions migrate individually or by means of a domino-type effect through the mechanism. Ionic material 18 may consist essentially of silver, lead, iron, or other ions leached or otherwise infused into memory element 10 from wire lead 12 and/or solder connection means or the like.

The present invention is directed to development of partition means in a memory element for dividing the memory element into a small "sacrificial" first portion which will later become contaminated with ionic material 18 when communicated with wire lead means and a relatively larger "unpoisoned" second portion protected from ion contamination by the partition means. Thus, the alloy mechanism comprising the second portion will continue to exhibit substantially unspoiled shape-memory effect characteristics even after attachment of wire leads to the first portion and introduction of an electrical operating current into the mechanism.

Figure 2:
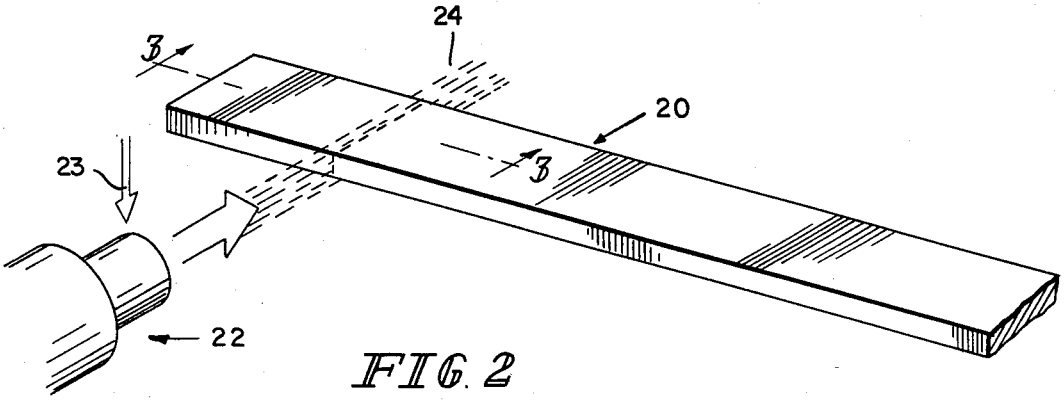
FIG. 2 is a perspective view of a memory element during exposure to energy generated by a laser beam.

A preferred method of creating the above-described partition means in an uncontaminated memory element 20 is illustrated in FIG. 2. An energy source 22 is moved, for example, in the direction of double arrow 23 to direct a stream of energy represented by broken lines 24 through a selected portion of memory element 20. Energy stream 24 can be provided by, for example, lasar means, electron beam means, shock wave means, ultrasonic wave means, microwave means, electrical capacitive means, TIG-welding means, resistance welding means, or the like.

Energy stream 24 is of sufficient magnitude and character to disrupt the crystalline structure of the alloy mechanism comprising memory element 20. Such disruption is continued for a period of time sufficient to create localized melting and to otherwise alter the normal crystalline structure of the alloy mechanism to provide a predetermined dissimilar structure having ion migration-blocking properties. Thus, a region having a different internal structure is created within memory element 20. Although it is thought that this different internal structure is amorphous, it is suspected that a crystalline structure could also provide suitable partition means.

An energy stream having a magnitude and character less than that which is required to weld a silver lead to a nitinol memory element has been found to be satisfactory. For example, an intensity of about 1.2–1.9 kv is satisfactory and slightly less than a conventional welding intensity of about 2.0–2.7 kv. It has been found that if the intensity of the energy stream is too great, a region of increased resistivity could be formed in the thermally-stressed partitioning region, thereby creating an unwanted hot spot. The selection and operation of equipment suitable to provide such an energy stream 24 will be known to those of ordinary skill in the art.

Figure 3:
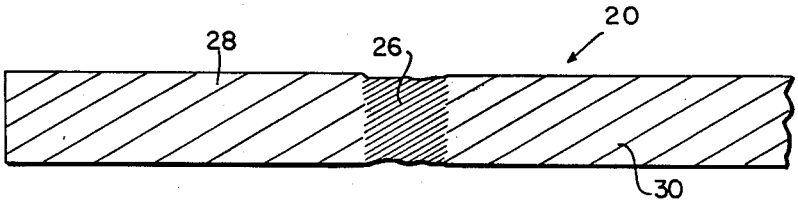
FIG. 3 is an enlarged sectional view taken along lines 3—3 of FIG. 2 illustrating a first embodiment of the present invention and diagrammatically showing the dissimilar internal structure of the partition means as compared to the like internal structures of the spaced-apart lead-attachment and shape-memory portions.

One arrangement of the two internal structures in memory element 20 produced using the above-described method is illustrated in FIG. 3. Partition means 26 created by energy stream 24 bifurcates memory element 20 to provide lead-attachment portion 28 and shape-memory portion 30. Portions 28 and 30 comprise the normal crystalline internal structure of the alloy mechanism comprising memory element 20 while partition means 26 comprises a thermally-stressed dissimilar internal structure. In particular, the dissimilar internal structure is configured to block transmigration of selected ions between the lead-attachment and shape-memory portions 28, 30.

Figure 4:
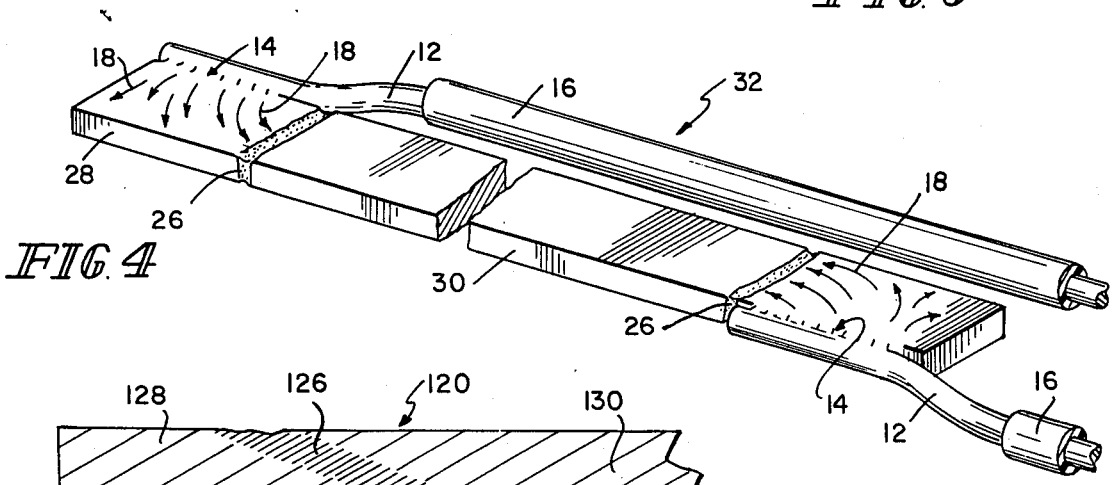
FIG. 4 is an enlarged perspective view of the memory element of FIG. 3 after attachment of a wire lead to each of the distal first portions.

A preferred complete memory assembly 32 is illustrated in FIG. 4. In practice, a wire lead 12 is connected to each end of a memory element after formation of the thermally-stressed partition means to provide means for heating the memory element to a predetermined temperature so that the memory element moves to assume a predetermined shape. U.S. Pat. Nos. 4,543,000 and 4,601,705 and U.S. patent application Ser. No. 06/870,926, filed June 5, 1986, disclose memory elements suitable for treatment by the method of the present invention and an operative environment for such memory elements and are hereby incorporated by reference.

In operation, power is provided to the lead-attachment portions 28 to heat the memory element in FIG. 4 sufficiently to induce reverse martensitic transformation of the alloy mechanism comprising the memory element. However, ionic material 18 communicated to the lead-attachment portions 28 from wire leads 12 and/or solder connection means is substantially blocked by the partition means 26 to prevent movement into shape-memory portion 30. Thus, shape-memory portion 30 retains the shape-memory effect characteristics of the basic alloy mechanism comprising the memory element.

Importantly, partition means 26 has an altered internal structure which acts to filter selected ionic materials 18 without substantially inhibiting the flow of electric current into shape-memory portion 30. Thus, exposing a selected portion of memory element 20 to energy 24 acts to change somewhat the molecular structure of the alloy mechanism comprising a memory element 20 without substantially changing the electrical conductivity or mechanical properties of such mechanism.

It will be appreciated that an applied electric current heats the alloy mechanism comprising the shape-memory portion 30 to a transformation temperature which causes said portion 30 to move to assume its predetermined shape. Operation of the memory element is not substantially impaired due to any partial or complete failure of a lead-attachment portion 28 to perform in accordance with its own shape-memory effect characteristics resulting from ion poisoning or contamination since the shape-memory portion 30 is dimensionally larger than either of the lead-attachment portions 28.

EXAMPLE

A nitinol element and a silver lead wire are rigidly held in good contact with one another in an aluminum fixture. The fixture is formed to include holes on top for allowing Argon gas flow. A laser beam provided by an Nd doped glass laser head is used to create barrier region 26 in the nitinol memory element 20. A selected portion of element 20 is exposed to a laser intensity of about 1.2 to 1.9 kv to create region 26. A typical weld intensity is about 2.0 to 2.7 kv. The exposure duration is about 30 pulses per minute and the target element is mechanically moved in between pulses.

An analysis of the silver concentration in several nitinol memory elements demonstrates the ion migration-blocking effectiveness of barrier 26 provided in a nitinol memory element made in accordance with the method of the present invention. For purposes of this analysis, a "non-barriered" element is a conventional nitinol memory element, while a "barriered" element is a nitinol memory element treated using a laser energy source 22 to form a partition 26. Fragments of the center portion of each non-barriered element and of the shape-memory portion 30 of each barriered element were analyzed using conventional graphite furnace atomic absorption techniques and instrumentation to determine the silver concentration therein.

The above-described analysis produced the following results for test elements Nos. 1–4: (1) a non-barriered element with silver leads attached had 72 parts per million of silver; (2) a barriered element with silver leads attached, the element having been exposed to a temperature-activation cycle, had only 5 parts per million of silver; (3) an "uncycled" barriered element with silver leads attached had only 3.8 parts per million of silver; and (4) an "uncycled" barriered element without any leads attached had 2.6 parts per million of silver. The reduction in transmigaration of silver ions from a "poisoned" lead-attachment portion 28 to an "uncontaminated" shape-memory portion 30 is clearly evidenced by the decrease in silver concentration in test element Nos. 2 and 3 as compared to test element No. 1. Accordingly, this illustrative data demonstrates that barrier 26 effectively blocks transmigration of selected silver ions between the lead-attachment and shape-memory portions 28, 30 of a nitinol memory element treated in accordance with the present invention.

Figure 6:
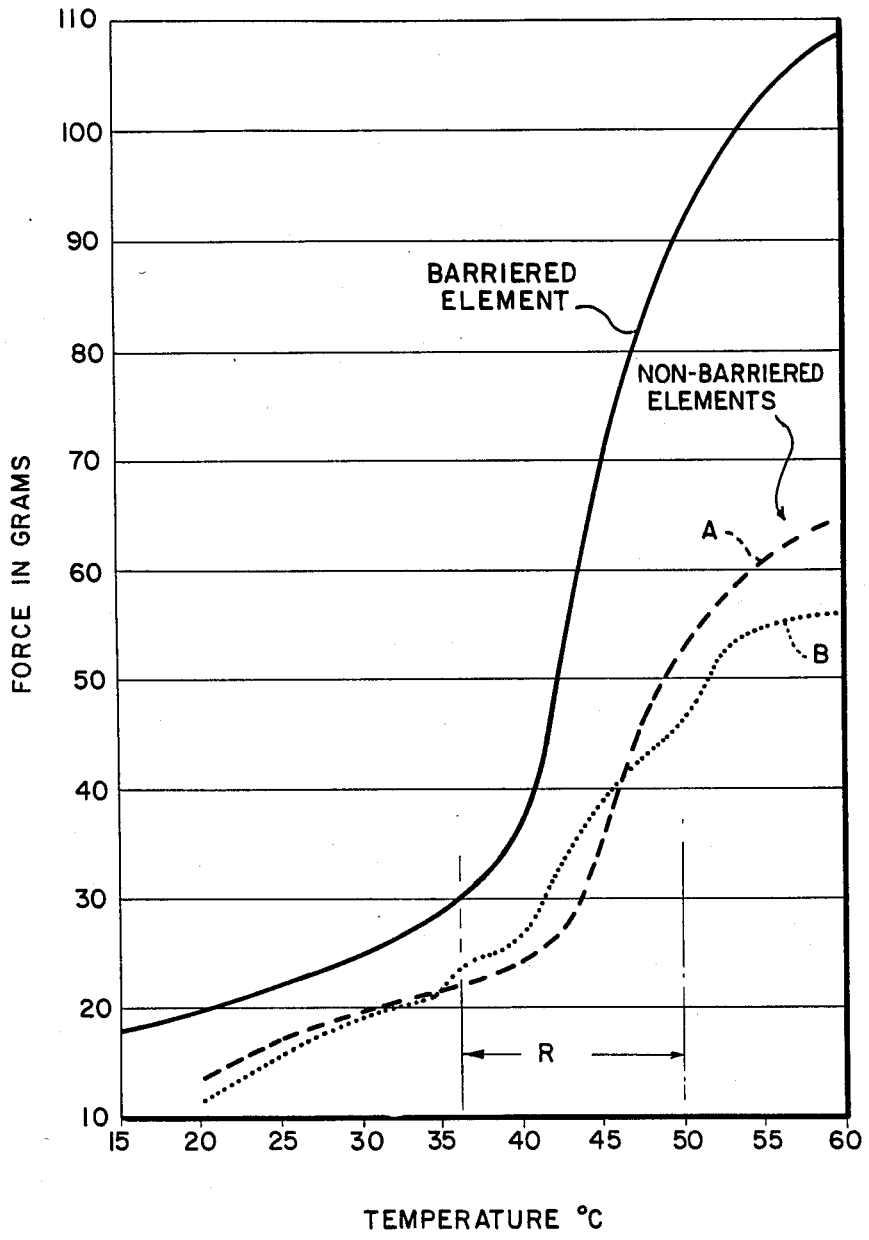
FIG. 6 is a graph illustrating a plot of element tip force versus element temperature for several cycled memory elements and demonstrating improved operation of a memory element made in accordance with the present invention as compared to conventional memory elements.

An improvement in the shape-memory effect function of a barriered memory element as compared to non-barriered memory elements is demonstrated in FIG. 6. A plot of the force generated by a distal tip of three different nitinol memory elements versus the temperature of each memory element is illustrated in FIG. 6. As indicated in FIG. 6, these three elements comprise: (1) a barriered memory element made in accordance with the present invention; (2) a non-barriered memory element "A" with welded leads; and (3) a non-barriered memory element "B" with soldered leads. Dimension "R" in FIG. 6 is representative of a range of normal memory element operating temperatures between 37° C. and 50° C. Each of the above-noted barriered and non-barriered memory elements were "cycled" as a result of undergoing a plurality of martensitic transformation cycles prior to testing.

It will be understood that the tip of each memory element of the type illustrated in FIGS. 1 and 4 will exert a force on a tip-contacting force-measuring sensor as the tip-bearing distal end of the memory element moves to assume its predetermined shape. For example, a predetermined bent shape is illustrated in U.S. Pat. No. 4,543,090 to McCoy.

A barriered memory element having a welded silver lead generates substantially greater tip force over a wide range of applied temperatures than non-barriered memory elements having either welded or soldered silver leads as indicated in FIG. 6. This data suggests that the shape-memory effect is more pronounced in barriered memory elements than in non-barriered memory elements since barriered memory elements exert significantly greater movement-inducing tip forces than non-barriered memory elements at equivalent temperatures. In other words, such element tip forces provide a reliable indication of the ability of a memory element to move to assume its predetermined shape when exposed to a predetermined transition temperature. In practice, such an ability increases in proportion to increased tip force. Accordingly, an advantageous improvement in operation of the barriered memory element over conventional non-barriered memory elements is clearly evident.

Figure 5:
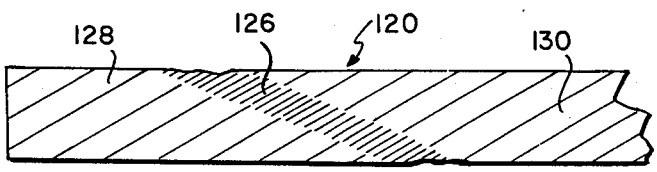
FIG. 5 is a sectional view similar to the view shown in FIG. 3 and illustrating a second embodiment of the present invention.

Another representative embodiment of an energy-treated uncontaminated memory element 20 is illustrated in FIG. 5. Although the orientation of partition means 126 is varied with respect to the memory element 120, the partition means 126 continues to bifurcate the memory element 120 to isolate ionic material 118 and lead-attachment portion 128, thereby preventing migration into shape-memory portion 130. It is expected that partition means could be oriented in a variety of attitudes relative to memory element 120 to provide the durability-enhancing features of the present invention.

Although the invention has been described in detail with reference to preferred embodiments and specific examples, variations and modifications exist within the scope and spirit of the invention as described and as defined in the following claims.

What is claimed is:

1. A memory element made of a shape-memory alloy, the memory element comprising first and second portions, each portion having a characteristic crystalline structure, and partition means for interconnecting the first and second portions, the partition means having an amorphous structure different than the characteristic crystalline structure of at least one of the first and second portions.

2. The memory element of claim 1, further comprising an electrically conductive lead connected to the first portion, the amorphous structure providing means for blocking transmigration between the first and second portions of selected ions indigenous to the electrically conductive lead to control the concentration of said selected ions in the second portion.

3. The memory element of claim 2, wherein the electrically conductive lead is one of soldered and welded to the first portion.

4. The memory element of claim 2, wherein the electrically conductive lead is silver.

5. The memory element of claim 4, wherein said selected ions consist essentially of silver ions.

6. The memory element of claim 2, wherein at least the second portion moves to assume predetermined shape when heated to a predetermined temperature and the amorphous structure is configured also to provide transmission means for communicating power between the first and second portions without permitting transmigration of said selected ions therebetween so that at least the second portion moves to assume its predetermined shape upon being heated to its predetermined temperature by the transmission means.

7. A memory element made of a shape-memory alloy, the memory element comprising first and second portions, each portion having a characteristic internal structure, and partition means for interconnecting the first and second portions, the partition means having a dissimilar internal structure.

8. The memory element of claim 7, wherein each characteristic internal structure is a crystalline structure and the dissimilar internal structure is an amorphous structure.

9. The memory element of claim 7, wherein the dissimilar second internal structure is configured to block transmigration of selected ions between the first and second portions.

10. The memory element of claim 7, further comprising an electrically conductive silver lead welded to the first portion, the dissimilar internal structure providing means for blocking transmigration between the first and second portions of silver ions to control the concentration of silver in the second portion.

11. The memory element of claim 10, wherein at least the second portion moves to assume a predetermined shape when heated to a predetermined temperature and the dissimilar internal structure is also configured to Provide means for communicating energy from the first portion to the second portion to its predetermined temperature so that at least the second portion assumes its predetermined shape.

12. The memory element of claim 7, further comprising an electrically conductive lead and connection means for coupling the electrically conductive lead to the first portion, the dissimilar internal structure being configured to provide means for blocking transmigration between the first and second portions of selected ions communicated from at least one of the connection means and the electrically conductive lead to control the concentration of selected ions indigenous to at least one of the electrically conductive lead and the connection means in the second portion.

13. The memory element of claim 12, wherein at least the second portion moves to assume a predetermined shape when heated to a predetermined temperature and the dissimilar internal structure is also configured to provide means for communicating energy from the first portion to the second portion to its predetermined temperature so that at least the second portion assumes its predetermined shape.

14. The memory element of claim 7, wherein the partition means is configured to provide filter means for substantially blocking transmigration of selected ions between the first and second portions.

15. The memory element of claim 14, wherein the partition means is also configured to provide conductor means for conducting an electrical current between the first and second portions.

16. The memory element of claim 15, further comprising an electrically conductive silver lead connected to the first portion, and wherein said selected ions consist essentially of silver ions extant in the first portion and the filter means is configured to provide means for controlling the concentration of silver in the second portion.

17. The memory element of claim 15, further comprising an electrically conductive lead and connection means for attaching the electrically conductive lead to the first portion, the selected ions blocked by the filter means being communicated from the electrically conductive lead to the first portion via the connection means.

18. The memory element or claim 7, wherein each of the first and second portions moved to assume a predetermined shape when heated to a predetermined temperature, and the dissimilar internal structure is configured to provide transmission means for communicating power between the first and second portions without permitting transmigration of selected ions therebetween so that at least one of the first and second portions moves to assume its predetermined shape upon being heated to its predetermined temperature by the transmission means.

19. A memory element made of a shape-memory alloy, the memory element comprising a lead-attachment portion, a shape-memory portion, and barrier means interconnecting the lead-attachment and shape-memory portions for blocking transmigration of selected ions from the lead-attachment portion to the shape-memory portion so that reverse martensitic transformation of the shape-memory portion at temperatures in excess of a threshold transformation temperature is not impaired due to the presence of said selected ions in the shape-memory portion.

20. The memory element of claim 19, wherein each of the lead-attachment and shape-memory portions have a characteristic internal structure and the barrier means has a dissimilar structure.

21. The memory element of claim 29, wherein each characteristic internal structure is a crystalline structure and the dissimilar structure is an amorphous structure.

22. The memory element of claim 19, further comprising an electrically conductive silver lead connected to the first portion, and wherein said selected ions consist essentially of silver ions extant in the first portion and the barrier means is configured to provide means for controlling the concentration of silver in the second portion.

23. The memory element of claim 19, further comprising an electrically conductive lead and connection means for coupling the electrically conductive lead to the lead-attachment portion, said selected ions being communicated to the lead-attachment portion from at least one of the electrically conductive lead and the connection means.

24. The memory element of claim 23, wherein at least the shape-memory portion moves to assume a predetermined shape when heated to a predetermined temperature and the barrier means includes means for communicating energy from the lead-attachment portion to heat the shape-memory portion to its predetermined temperature so that at least the shape-memory portion assumes its predetermined shape.

25. The memory element of claim 23, wherein each of the lead-attachment and shape-memory portions have a characteristic internal structure and the barrier means has a dissimilar internal structure configured to block transmigration of said selected ions from the lead-attachment portion to the shape-memory portion without substantially impeding electric current flow from the lead-attachment portion to the shape-memory portion.

26. The memory element of claim 25, wherein each characteristic internal structure is a crystalline structure and the dissimilar internal structure is an amorphous structure.

27. A memory element made of a shape-memory alloy having a first internal structure, the memory element comprising a first portion having said first internal structure, a second portion having said first internal structure, and partition means for interconnecting the first and second portions, the partition means having a dissimilar second internal structure, the partition means being formed by exposing a selected portion of the first internal structure between the first and second portions to an energy source.

28. The memory element of claim 27, wherein the first internal structure is a crystalline structure and the dissimilar internal structure is an amorphous structure.

29. The memory element of claim 27, wherein the energy source is a laser.

30. The memory element of claim 27, wherein the exposing step continues for a predetermined period of time to alter the first internal structure to provide the dissimilar second internal structure.

31. The memory element of claim 27, wherein the energy source includes means for generating energy having a magnitude sufficient to disrupt the internal structure of the selected portion to provide the dissimilar second internal structure.

32. A memory assembly comprising a memory element made of a shape-memory alloy, the memory element including a lead-attachment portion and a shape-memory portion, each of said portions having a characteristic internal structure, and an electrically conductive lead connected to the lead-attachment portion, the memory element further including partition means for interconnecting the lead-attachment and shape-memory portions, the partition means defining a thermally-stressed zone having an internal structure dissimilar to at least one of the characteristic internal structures of the memory element induced by exposure to thermal stress before the lead is connected to the lead-attachment Portion.

33. The memory assembly of claim 32, wherein the thermally-stressed zone is configured to provide means for blocking transmigration between the lead-attachment and shape-memory portions of selected ions indigenous to the electrically conductive lead to control the concentration of said selected ions in the shape-memory portion.

34. The memory assembly of claim 33, wherein the electrically conductive lead is silver and said selected ions consist essentially of silver ions.

35. A memory assembly comprising a memory element made of a shape-memory alloy, the memory element including a lead-attachment portion and a shape-memory portion, and a silver lead connected to the lead-attachment portion, the lead-attachment portion providing a source of silver ions extant therein and communicated from the silver lead, the memory element further including means interconnecting the lead-attachment and shape-memory portions for regulating transfer of silver ions from the lead-attachment portion to the shape-memory portion to control the concentration of silver in the shape-memory portion.

36. A memory element made of a shape-memory alloy having a crystalline internal structure, the memory element comprising partition means for dividing the shape-memory alloy into first and second portions, the partition means having a dissimilar internal structure.

37. A memory element made of a shape-memory alloy, the memory element comprising first and second portions having first internal structures, and partition means for separating the first and second portions, the partition means having a dissimilar second internal structure.

38. A method of making a temperature-activated memory element, the method comprising the steps of providing a mechanism made of a shape-memory alloy having a crystalline structure, exposing a selected portion of the mechanism to an energy source to divide the mechanism into first and second portions interconnected by the selected portion, and continuing the exposing step for at least a predetermined period of time sufficiently to disrupt the crystalline structure of the selected portion to alter the crystalline structure to provide a dissimilar structure configured to block transmigration of selected ions between the first and second portions.

39. The method of claim 38, wherein the energy source is a laser.

40. The method of claim 38, wherein the dissimilar structure is configured to provide means for conducting an electrical current between the first and second portions.

41. The method of claim 38, further comprising the step of connecting an electrically conductive lead only to the first portion after the exposing and continuing steps to provide means for applying an electric current to the mechanism, the selected portion providing a partition intermediate the first and second portions to isolate in the first portion selected ions communicated from the electrically conductive lead to the first portion.

42. The method of claim 38, wherein the dissimilar structure is configured to provide means for conducting an electrical current between the first and second portions so that an electric current is applicatory to the second portion via the electrically conductive lead, the first portion, and the selected portion without causing said selected ions to transmigrate from the first portion to the second portion.

43. A method of making a temperature-activated memory element, the method comprising the steps of providing a mechanism made of a shape-memory alloy having a crystalline structure, thermally stressing a selected portion of the mechanism to divide the mechanism into first and second portions interconnected by the selected portion and alter the crystalline structure to provide a dissimilar structure configured to provide means for blocking transmigration of selected ions between the first and second portions.

44. The method of claim 43, further comprising the step of connecting an electrically conductive lead only to the first portion to provide means for applying an electric current to the mechanism subsequent to the thermally stressing step, said selected ions being indigenous to the electrically conductive lead.

45. A memory element comprising lead-attachment and shape-memory portions made of a shape-memory alloy, and barrier means communicating with the lead-attachment and shape-memory portions for blocking transmigration of selected ions from the lead-attachment portion to the shape-memory portion.

46. The memory element of claim 45, further comprising a silver lead connected to the lead-attachment portion, and wherein said selected ions consist essentially of silver ions extant in the lead-attachment portion and the barrier means is configured to provide means for controlling the concentration of silver in the shape-memory portion.

47. The memory element of claim 45, further comprising an electrically conductive lead and means for coupling the electrically conductive lead to the lead-attachment portion, and wherein said selected ions are indigenous to at least one of the electrically conductive lead and the coupling means.

48. A memory assembly comprising a lead-attachment element made of a shape-memory alloy, a shape-memory element made of the shape-memory alloy, an electrically conductive lead, means for coupling the electrically conductive lead to the lead-attachment element, barrier means communicating with the lead-attachment and shape-memory elements for regulating transfer of selected ions indigenous to at least one of the electrically conductive lead and the coupling means from the lead-attachment element to the shape-memory element to control the concentration of said selected ions in the shape-memory element.

* * * * *

UNITED STATES PATENT AND TRADEMARK OFFICE

CERTIFICATE OF CORRECTION

PATENT NO. : 4,777,799

DATED : October 18, 1988

INVENTOR(S) : William C. McCoy, et al.

It is certified that error appears in the above-identified patent and that said Letters Patent is hereby corrected as shown below:

At column 5, line 16, please delete "lasar" and insert therefor --laser--;

At column 10, line 3, please delete "29" and insert therefor --20--; and

At column 11, line 15, please delete "Portion" and insert therefor --portion--.

Signed and Sealed this

Eleventh Day of July, 1989

*Attest:*

DONALD J. QUIGG

*Attesting Officer*

*Commissioner of Patents and Trademarks*